US009856728B2

(12) United States Patent
Fink et al.

(10) Patent No.: US 9,856,728 B2
(45) Date of Patent: Jan. 2, 2018

(54) METHOD AND APPARATUS FOR REMOVING LIQUID FROM A GAS PRODUCING WELL

(71) Applicant: CNX Gas Company LLC, Canonsburg, PA (US)

(72) Inventors: Joseph M. Fink, Washington, PA (US); Richard M. Wright, Clarksburg, PA (US)

(73) Assignee: CNX Gas Company LLC, Canonsburg, PA (US)

( * ) Notice: Subject to any disclaimer, the term of this patent is extended or adjusted under 35 U.S.C. 154(b) by 0 days.

(21) Appl. No.: 15/166,944

(22) Filed: May 27, 2016

(65) Prior Publication Data

US 2017/0022794 A1 Jan. 26, 2017

Related U.S. Application Data

(63) Continuation of application No. 13/218,915, filed on Aug. 26, 2011, now Pat. No. 9,376,895.

(60) Provisional application No. 61/377,716, filed on Aug. 27, 2010.

(51) Int. Cl.

| | |
|---|---|
| ***E21B 43/12*** | (2006.01) |
| ***F04B 47/02*** | (2006.01) |
| ***E21B 43/34*** | (2006.01) |
| *E21B 43/00* | (2006.01) |

(52) U.S. Cl.

CPC ..... *E21B 43/34* (2013.01); *E21B 43/122* (2013.01); *E21B 43/126* (2013.01); *E21B 43/127* (2013.01); *F04B 47/02* (2013.01); *E21B 43/006* (2013.01)

(58) Field of Classification Search

CPC ..... F04B 47/02; E21B 43/127; E21B 43/126; E21B 43/34; E21B 43/12; E21B 43/121; E21B 43/122

USPC ..... 166/72, 75.12, 372, 302, 57, 267; 74/41

See application file for complete search history.

(56) References Cited

U.S. PATENT DOCUMENTS

| | | | | |
|---|---|---|---|---|
| 2,169,815 A * | 8/1939 | Patterson | F04B 47/02 175/189 |
| 2,196,816 A | 4/1940 | Saxe | |
| 2,200,292 A | 5/1940 | Patterson | |
| 2,316,494 A * | 4/1943 | Tipton | F04B 47/02 318/444 |
| 2,520,187 A | 8/1950 | Wilshusen et al. | |
| 2,656,896 A * | 10/1953 | Glasgow | B01D 19/02 96/176 |
| 2,973,065 A | 2/1961 | Cordes | |
| 3,971,719 A | 7/1976 | Peters | |
| 4,086,960 A | 5/1978 | Haynes | |

(Continued)

FOREIGN PATENT DOCUMENTS

| | | |
|---|---|---|
| RU | 2246602 C2 | 2/2005 |
| SU | 1448078 A1 | 12/1988 |

*Primary Examiner* — George Gray

(74) *Attorney, Agent, or Firm* — Beck & Thomas, P.C.

(57) ABSTRACT

A method for pumping fluid at a wellhead. The invented method will improve liquid removal by eliminating the need to transport liquid produced from a well to containment facilities using trucks or large diameter pipelines capable of accommodating periodic surges of a high volume of fluid. The danger that the liquid will freeze in cold weather is also addressed. The invention removes liquid from the well site through a small diameter pipeline as a continuous flow at a constant flow rate.

8 Claims, 6 Drawing Sheets

(56) References Cited

U.S. PATENT DOCUMENTS

| | | | | | |
|---|---|---|---|---|---|
| 4,099,447 | A | | 7/1978 | Ogles | |
| 4,512,149 | A | * | 4/1985 | Weaver | F04B 47/02 60/371 |
| 4,699,719 | A | * | 10/1987 | Finley | B01D 17/0208 210/104 |
| 5,335,728 | A | | 8/1994 | Strahan | |
| 5,507,858 | A | * | 4/1996 | Jepson | B01D 19/0031 95/262 |
| 5,590,716 | A | | 1/1997 | Mansfield | |
| 5,735,170 | A | | 4/1998 | Bales et al. | |
| 6,175,210 | B1 | | 1/2001 | Schwartz et al. | |
| 6,299,672 | B1 | | 10/2001 | Rivas | |
| 7,275,599 | B2 | | 10/2007 | Wilde | |
| 7,350,581 | B2 | | 4/2008 | Wynn | |
| 8,297,350 | B2 | | 10/2012 | Zupanick | |
| 2006/0151167 | A1 | * | 7/2006 | Aarvik | E21B 43/00 166/267 |
| 2010/0180768 | A1 | | 7/2010 | Folkvang | |
| 2011/0268586 | A1 | * | 11/2011 | Rogers | F04B 47/02 417/53 |

* cited by examiner

METHOD AND APPARATUS FOR REMOVING LIQUID FROM A GAS PRODUCING WELL

CROSS-REFERENCE TO RELATED APPLICATIONS

The present application is a continuation of U.S. patent application Ser. No. 13/218,915, filed Aug. 26, 2011, which claims the benefit of U.S. Provisional Application No. 61/377,716, filed Aug. 27, 2010, which are hereby incorporated by reference in their entireties.

STATEMENT REGARDING FEDERALLY SPONSORED RESEARCH OR DEVELOPMENT

Not Applicable

INCORPORATION-BY-REFERENCE OF MATERIALS SUBMITTED ON A COMPACT DISK

Not Applicable

BACKGROUND

Field of the Invention

This invention relates, in general, to the production of fluids from a hydrocarbon producing well. In particular, this invention relates to efforts to provide systems for the gathering of natural gas which use the space in and around the well site as efficiently as possible.

Description of the Related Art

Fluids are produced from hydrocarbon producing formations under the Earth's surface. An example of a hydrocarbon producing formation is a coal seam. Coalbed Methane (CBM) is produced by drilling a well into a coal formation and collecting the entrapped methane gas located within the formation. While entrapped in the formation, the methane gas is under pressure. The gas naturally migrates to the low pressure area created by the well. Liquids such as water similarly migrate to this low pressure area.

Liquid Removal

The accumulated liquid must be removed so that gas can continue to flow from the well. In a typical pumping arrangement, the liquid is drawn to the surface through tubing running from a down-hole pump located at the bottom of the well to the surface. Gas flows from the well through the annulus, the space between the well and the tubing. Once brought to the surface, the liquid must be removed from the well site. Currently, two methods are used to remove the liquid.

Liquid Removal by Truck

One method of gathering and disposing of the liquid is to pump fluids directly from the well into localized tanks or other holding facilities. Trucks then travel to and from the collection tank to dispose of the liquid. However, this method requires a great deal of man power, reliable roads, and expensive road maintenance. The weight and amount of travel from the trucks damages roads to well sites as well as any community roads which the trucks must travel on during the trip to the collection facility. Local communities often require gas producer to pay for maintenance of the community roads. The expense and liability of on-road fluid gathering and distribution can be costly and potentially unpopular within the community. In the winter snow and ice can create adverse road conditions that make it difficult for trucks to travel to and from the well site.

Liquid Removal by Pipeline

A second method of removing liquid is to install a pipeline for the liquid to enter as it exits the well. The pipeline could run from the well site to a collection facility. Conventionally, the pump-jack and/or down-hole pump is the mechanism used to push the liquid through the pipeline because it has positive displacement capabilities far beyond what is necessary to simply bring fluids to the surface. The excess pressure capability can be utilized as the mechanism to push liquid through a pipeline network to the central collection facility. However, a disadvantage of using the pump-jack to force liquid through a pipeline is that the pump-jack will cause a pressure surge or water hammer to move through the pipeline. Therefore, a larger diameter pipeline is required to accommodate these short duration surges, than would be required if the same total volume of liquid moved through the pipeline at a substantially constant flow rate.

Problems Caused by Gas/Liquid Mixtures

Fluid, brought to the surface by a well, typically contains a liquid component and a gas component. The presence of the gas component raises additional problems which are not fully addressed by conventional methods of gas and liquid separation and removal. When the fluid is pumped directly to the pipeline without conventional gas and liquid separation, any gas entrained in the liquid is typically lost. This problem is further compounded by a condition know as over-pumping. Over-pumping occurs when the pump operates more than is necessary to remove the liquid from the well. Once the liquid is removed from the well and the pump continues to run, natural gas is allowed to escape from the wellbore and is pumped into the tubing and into the liquid pipeline. The presence of gas in the liquid pipeline also makes it difficult to accurately measure the volume of liquid which is removed from the well because currently used methods for measuring flow through a pipeline cannot distinguish between gas flow and liquid flow.

When gas is introduced into a liquid pipeline the possibility of an air-locking condition is created. Air-locking occurs when gas gathers in the highest elevations in the pipeline and causes a complete or partial blockage of liquid flow. The gathering of gas can be from gas that separates from the fluid mixture or from gas that is introduced when the well is over-pumped. When air-locking occurs the liquid cannot be pushed past the gas blockage. As the pump continues to try to force liquid past the air-lock blockage, the pressure in the portion of the pipe before the blockage continues to increase. When the pressure reaches a pressure beyond the maximum rating of the pipeline, a rupture can occur. Pipeline ruptures can be difficult to diagnose and locate. Furthermore, ruptures can be expensive both in terms of costs associated with repairing damaged equipment and in cleaning up environmental damages from liquid which leaks from the ruptured pipeline.

In addition to the risk of pipeline rupture, the pump-jack also creates pressure on the wellhead itself and the packing surrounding the wellhead. The pump-jack is typically connected to the down-hole pump by steel rods that extend from the entire depth of the well. The rod connected to the pump-jack at the surface is known as the polish rod because of its smooth and polished surface. A packing material at the wellhead allows the polish rod to move up and down in the well while containing the pressure of the water in the tubing. This packing must be monitored frequently because it often leaks unexpectedly and has to be replaced on a frequent basis. In fact, spillage associated with packing leakage is difficult if not impossible to eliminate.

Cold Weather

Another problem associated with current methods of storing, removing, and transporting liquid such as water from a well site is the danger that the liquid will freeze during cold weather. The frozen water can limit well production and also rupture pipelines and promote wellhead spillage.

Installation and Servicing Concerns

Finally, current methods of setting up a pumping assembly at a well site take two to three days before the site is ready to begin pumping fluid from the well. Under the current method of installing a pumping assembly, the pump is assembled in a piecemeal fashion at the well site. As a result, even pumping assemblies located close together often are not constructed according to a uniform plan and do not use the same components. The piecemeal method of installation takes a long time to complete and makes maintenance and repair difficult. Furthermore, space within the pumping assembly is not utilized as efficiently as possible. As a result, the footprint of the installed pumping assembly is larger than is necessary to accomplish all functions of the assembly. Similarly, as a result of the lack of uniformity in gas well construction and large footprint area, gas wells generally do not have a uniform aesthetically pleasing appearance.

In addition to difficulties created by current installation practices, further difficulties arise because gas producing wells must be serviced regularly. To service the down-hole pump and other elements located within the well, a large truck hauling a gin pole and pulley system must drive up to the well site. The pulley system is used to hoist the down-hole portions of the pumping assembly from the well. The problems associated with building and maintaining access roads to the well site, described above for liquid transportation trucks, applies similarly to these service trucks which also must access the well site regularly.

For the reasons stated above, there is a need for a method and apparatus for removing liquid from a well site which can accomplish liquid removal without the use of hauling trucks or large diameter pipelines. Furthermore, the apparatus and method should prevent complications that lead to air-locking and pipeline ruptures. The method and apparatus should also address the problem of pipeline freezing so that it can be used in cold weather. Finally, there is a need for a method and apparatus for liquid removal which makes more efficient use of space in and around the wellhead and which can be installed more quickly so that pumping can begin in a more timely fashion. Furthermore, the gas well should have a uniform aesthetically pleasing appearance.

BRIEF SUMMARY

Pumping Fluid at a Wellhead

A method for pumping fluid at a wellhead according to the present invention requires forming a well center unit comprising: a pumping assembly for pumping fluid from a well; a support structure for supporting the assembly; a holding tank positioned below the support structure, having an inflow port, connected to the pumping assembly, and an outflow port; and a holding tank pump. The well center unit is connected to the wellhead and into the well. The well center unit could include a power source capable of operating both the pumping assembly and the holding tank pump. The holding tank could allow for depressurization.

The invented method may further include: allowing the fluid in the holding tank to separate to a liquid component and, if a gas component is present, a gas component; removing the gas component from the holding tank through a gas outflow conduit; and forcing the gas component to a gas pipeline. The liquid component could similarly be removed from the holding tank at a substantially constant flow rate through an outflow port having a smaller cross-sectional area than the inflow port. The invention could further include warming the fluid in the holding tank so that the fluid will not freeze. Exhaust heat, vented from the power source, could be used to create the warming.

The well center unit could be anchored to the ground and also to the wellhead. In addition, the support structure could have a removable gin pole for servicing the well when necessary. Gas and water metering devices could be housed underneath the support structure. A gas conditioning device could also be located underneath the support structure. The well center could be enclosed with a guarding structure in order to prevent access from unwanted persons.

Well Management Center Unit

A well management center unit according to the present invention includes: a pumping assembly for pumping fluid from a well; a support structure for supporting the assembly; a holding tank positioned below the support structure, having an inflow port, connected to the pumping assembly, and an outflow port; and a holding tank pump. The well management center could further include a power source that operates both the pumping assembly and the holding tank pump. Exhaust heat from the power source could warm liquid in the holding tank. The well management center could further include a removable gin pole to be used when servicing the center. The gin pole is used for hoisting down-hole elements of the pumping apparatus from the well. The gin pole has a crank which could be turned by hand. The crank could also be powered by the same single power source which powers the down-hole pump and the holding tank pump. The well management center could be enclosed within a housing structure for security purposes. It could further include water and gas metering apparatus within the support structure. The well management center could include a gas conditioning device.

Removing Liquid

A method of removing a liquid from a gas producing well according to the present invention requires accepting a periodic surge of fluid, brought to the surface by a down-hole well pump driven by a power source, into a holding tank located under the wellhead, through an inflow conduit having a cross-sectional area capable of accepting the surge. Once the fluid is in the holding tank, it is allowed to separate to a liquid component and, if there is a gas component present, a gas component. The holding tank could be warmed so that the fluid does not freeze. The liquid component is removed from the holding tank through an outflow conduit having a smaller cross-sectional area than the inflow conduit. A power source could be used to power both the down-hole pump and a holding tank pump for removing the liquid component from the holding tank. The gas component could, similarly, be removed from the holding tank through a gas outflow conduit and forced to a gas pipeline. Once it is removed from the holding tank, the liquid component is forced, at the substantially constant flow rate, from the outflow conduit through a pipeline, thereby removing the liquid from the well. The forcing could be performed by a pump other than the down-hole well pump.

Pumping Fluid

A method for pumping fluid at a wellhead according to the present invention requires forming a well center unit having: a pumping assembly for pumping fluid from a well; a support structure for supporting the assembly; a holding tank positioned below the support structure, having an inflow port, connected to the pumping assembly, and an outflow port; and a holding tank pump. The well center unit could further include a power source capable of operating both the pumping assembly and the holding tank pump. Once the well center unit is formed, the well center unit is coupled to the wellhead and into the well. The well center unit could be anchored to the ground.

Elevating Apparatus

An apparatus for elevating a pumping assembly according to the present invention includes a pumping assembly for drawing fluid from a well. The pumping assembly is elevated by a support structure having a lower cavity underneath the support structure. A holding tank is located inside the lower cavity. The holding tank has an inflow port for receiving fluid from the pumping assembly and an outflow port wherein the total cross-sectional area of the inflow port is greater than the total cross-sectional area of the outflow port. A holding tank pump is connected to the outflow port for forcing fluid from the outflow port to a pipeline. The apparatus could further include a power source operably connected to the well pump and the holding tank pump for driving both the well pump and the holding tank pump. The apparatus for elevating a pumping assembly is used according to the method for removing a liquid from a gas producing well described above.

Therefore, the general object of this invention is to provide an apparatus and method for pumping fluid at a wellhead more cheaply and without the problems, such as over-pumping, air-locking, wellhead packing, and pipeline rupture, associated with current methods. Specifically, an object of the invention is to allow for the use of a small diameter pipeline for removing liquid from a well site which continues to work effectively even in cold weather. Liquid should flow through the pipeline at a substantially constant flow rate so that liquid volume produced can be measured using currently available measuring devices. In addition, an object of the invention is to improve the efficiency of pumping by limiting the amount of natural gas which escapes through the liquid pipeline and by recovering as much of that gas as possible. A further object of the invention is to use the space around the wellhead more efficiently so that the footprint area of the pumping assembly is effectively reduced. Finally, since wells are constructed according to uniform designs, it is an object of this invention to reduce the time required to install a pumping assembly so that the pump can begin removing liquid from the well more quickly. A result of the decreased footprint size and more uniform design is that the gas wells, both individual wells and multiple wells located close together, will be more aesthetically pleasing than well designs which are currently available.

DETAILED DESCRIPTION

Examples and Explanatory Definitions

Figure 1:
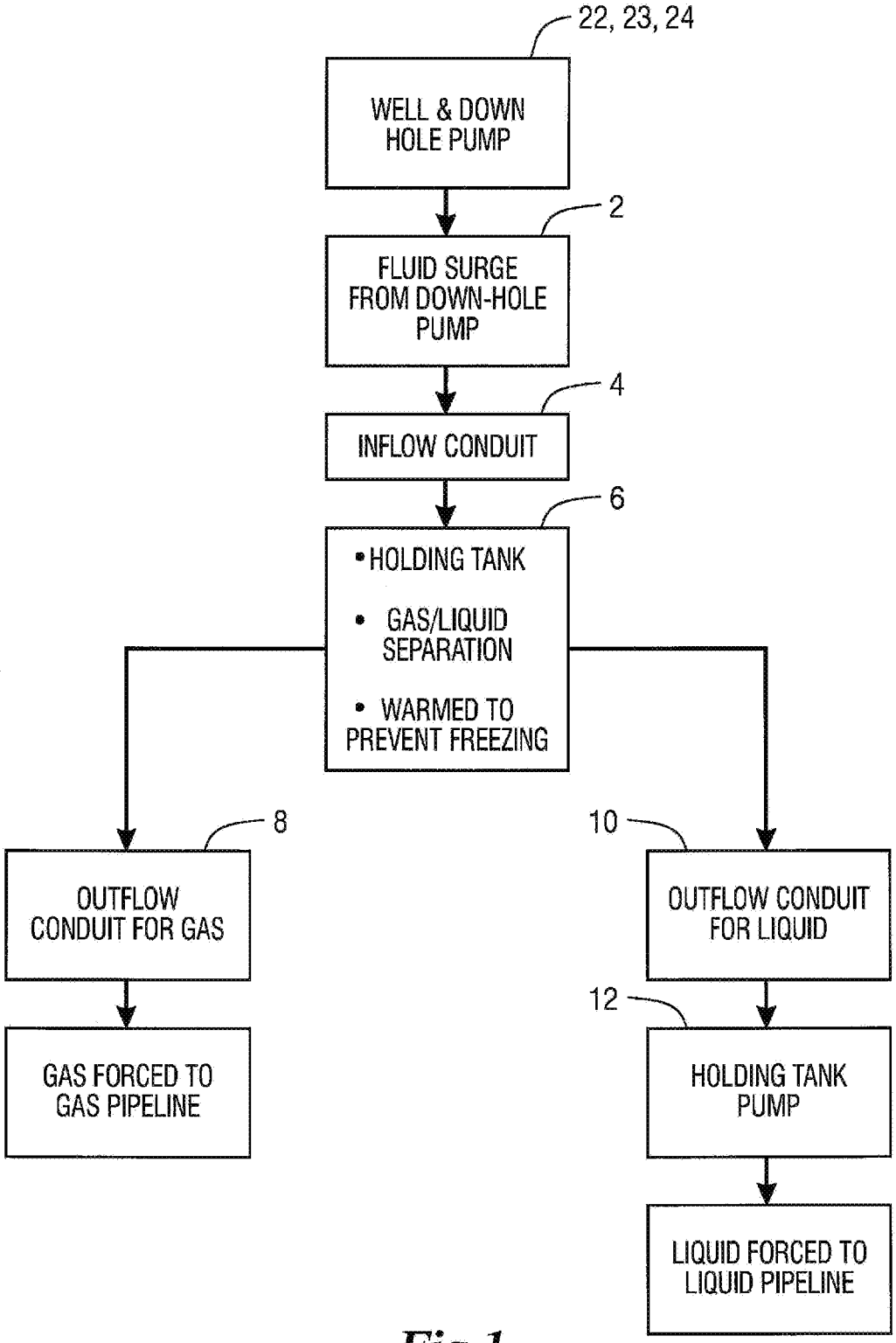
FIG. 1 shows a flow chart describing how the surge of a fluid is accepted from the down-hole pump. The flow chart traces the fluid from the down-hole pump, through separation in the holding tank, to removal from the well site by a pipeline.

The examples and explanatory definitions provided below are inclusive and are not intended to limit what is within the meaning of these terms.

"gas producing well"—means a well for producing natural gas. Natural gas wells can be drilled into a number of rock formations. In one embodiment of the invention, the well could be drilled into a coal formation.

"fluid"—A fluid is a substance which continually deforms under an applied shear stress. Essentially, a fluid is able to flow when a shear stress is applied. A fluid may be a gas or a liquid or a mixture containing both liquid and gas components. A foam having gas bubbles within a liquid is an example of a fluid. A foam of natural gas and liquid is often brought to the surface by a gas producing well.

"well center unit"—The well center unit is an assembly capable of drawing fluid from a well, separating the fluid to a liquid component and a gas component, and removing the liquid component from the well site. Rather than building the assembly on the wellhead, the unit is pre-formed and installed to the wellhead as a single unit.

"forming"—Forming refers to the manufacturing and assembly process necessary to create the well center unit. In one embodiment of the instant invention, the unit would be formed offsite, for example at a manufacturing facility, and then transported to the well site for installation.

"pump"—A mechanical device using pressure or suction to raise or move fluids. A pump could be powered by a natural gas combustion engine or by an electric motor or any other power source.

"pumping assembly"—The pumping assembly includes the pump-jack, the rod string, and the down-hole pump.

"support structure"—The support structure is a base for anchoring and supporting the pump-jack and/or mast and pulley driver. The support structure also functions as an elevator for raising and reorienting the pump-jack.

"positioned below the support structure"—The support structure forms a lower cavity below the pump-jack. In one embodiment of the invention, the holding tank is located within the lower cavity.

"port"—A port is an orifice or conduit allowing a fluid to flow into or be removed from the holding tank. In the case of a liquid, the port could be a drain.

"holding tank pump"—A pump for moving liquid from the outflow conduit to a pipeline. The pump operates at a steady state meaning that when liquid is present in the holding tank, it will be pumped by the holding tank pump as a continuous flow having a substantially constant flow rate.

"coupling"—The well center unit is coupled to the wellhead and into the well by arranging the elements of the well center unit at the corrected locations in and around the well. For example, the down-hole pump is located in the well; the pump-jack is located at the wellhead; and the holding tank is positioned below the pump-jack.

"power source"—A device that provides energy sufficient to drive the holding tank pump and the down-hole pump. The power supply device could be an electrical engine, a combustion generator that provides electrical power, a combustion engine powered by natural gas, or any other device that provides power or energy.

"capable of operating"—The power supply should be powerful enough and arranged so that it can provide power to both the down-hole pump and the holding tank pump. However, the pumps should be able to operate independently so that the pumps can pump fluid at different rates and can turn on or off at different times independent of one another.

"depressurization"—Air-locking occurs when the down-hole pump can no longer draw fluid to the surface as a result of the increased pressure at the wellhead. Pressure near the wellhead increases as gas collects at the upper portions of the well. Depressurization removes the collected gas to reduce the pressure and prevent air-locking.

"warming"—The fluid in the holding tank should be kept at a temperature above the freezing point of the liquid component of the fluid even in cold weather. The freezing point of water is 0 degrees Celsius. In the case of a liquid mixed with solid fines, the freezing point may be lower. Warming can be accomplished by positioning the holding tank near enough to a device which produces heat so that the residual heat from the device keeps the holding tank above the freezing level.

"exhaust heat"—Refers to heated exhaust gases which are vented away from a power source such as an internal combustion engine and, in one embodiment of the invention, used to warm the holding tank.

"forcing"—The fluid or gas is forced from the outflow conduit to a pipeline. A common method for forcing a fluid through a pipeline is by using a pump. In some cases, gravity could also be used to force the gas or liquid through the pipeline.

"separate"—The invention includes any means of separating the liquid and gas components of a mixture. In one embodiment of the invention, the separation is natural separation where gravity causes the more dense material to collect at the bottom of the holding tank and less dense material to collect in the top portion of the tank. In the case of a natural gas and water foam, water would collect at the bottom of the tank and natural gas would collect at the top.

"liquid"—A liquid is a material in the state of matter having characteristics including a readiness to flow, little or no tendency to disperse, and a relatively high incompressibility. Liquids commonly drawn from a well include water and oil.

"inflow conduit"—Fluid enters the holding tank via the inflow conduit. The inflow conduit could be a pipe running from the wellhead to the holding tank. In an embodiment of the invention, the holding tank is positioned below the pump jack fluid flows.

"outflow conduit"—The outflow conduit is the port where separated gas or separated liquid is removed from the holding tank. In the case of a liquid, the outflow conduit could be a drain.

"holding tank"—The holding tank is a vessel for holding the fluid brought to the surface by the pump jack. The holding tank functions as a gas/liquid separation device which depressurizes the fluid.

"substantially constant flow rate"—The liquid or gas should be removed from the holding tank at a substantially constant flow rate. It is recognized that if the down-hole pump is not drawing fluid from the well, no fluid will be available to remove from the holding tank; however, when fluid is being supplied to the tank, the liquid component of the fluid should be removed from the tank as a substantially continuous flow at a constant rate. The intent is to avoid the periodic high volume, high flow rate surges which come from the wellhead.

"cross-sectional area"—The cross-sectional area of a conduit or pipe refers to the area outlined by the inner surface of the conduit. Cross-sectional area is, essentially, the area through which the fluid can flow. In the case of a circular pipe, cross-sectional area is equal to $(H)*(\text{inner radius})^2$.

"an outflow conduit having a smaller cross-sectional area than the inflow conduit"—The total cross-sectional area of the outflow must be less than the total cross-sectional area of the inflow. It is recognized that a holding tank could have a plurality of inflow or outflow conduits. In that case, the total cross-sectional area of the plurality of inflow conduits, rather than the cross-sectional area of any individual conduit, must be greater than the total cross-sectional area of the plurality of outflow conduits.

"removable gin pole"—A rigid pole with a pulley on the end used for lifting. In the instant invention, the gin pole is used to provide maintenance services to the well center unit when necessary. The gin pole is removable.

"service the well when necessary"—necessary service may include regularly scheduled maintenance activities as well as efforts to fix or replace broken elements of the apparatus.

"guarding structure"—The apparatus is encased within a guarding structure to reduce the likelihood that trespassers will vandalize the well management center unit or steal parts of the unit. The guarding structure could be a metal case surrounding the well management center.

"gas and water metering devices"—devices for measuring the volume of liquid (water) or gas (natural gas) flowing through a pipe. The present invention allows for the accurate measurement of the volume of liquid which flows through a pipeline because liquid flows through the pipeline at a substantially constant flow rate.

"gas conditioning device"—A device for conditioning natural gas so that the gas can be used by an internal combustion engine. Conditioning may include steps of both filtering the gas and drying the gas.

"periodic surge"—A surge of fluid drawn from a well by the pump jack. The surge can increase pressure in a pipeline and, in some circumstances, cause the pipeline to rupture. This type of fluid or pressure surge is often referred to as a "water hammer."

"capable of accepting the surge"—As described above, the fluid drawn from the well arrives at the holding tank in a periodic fashion with alternating intervals of high and low volume. To be capable of accepting the surge, the cross-sectional area must be great enough so that the entire high volume surge can flow into the holding tank without backing up and, as a result, increasing the pressure at the wellhead making it more difficult for fluid to flow from the well.

"down-hole pump"—A down-hole pump is a tool used in the well which draws fluid from the well into tubing and lifts that fluid to the surface. The down-hole pump is located in the well. It is used in conjunction with the pump-jack located on the surface and the rod string which connects the pump-jack to the down-hole pump.

"lower cavity"—The space below the support structure. In one embodiment of the invention, the lower cavity houses the holding tank.

Description

FIG. 1 shows a flow chart describing how the periodic surge 2 of a fluid is accepted from the down-hole pump. The flow chart traces the fluid as it is drawn from the well 24, to the wellhead 22, by the down-hole pump 23; through separation in the holding tank 6; to removal from the well site by a pipeline. The fluid is drawn from the well by a down-hole pump 23 with periodic surges 2 of a large volume of fluid. The fluid passes into the holding tank 6 through the inflow conduit 4. The fluid is separated to a gas component and a liquid component in the holding tank 6. The gas component is removed from the holding tank 6 through the outflow conduit for gas 8. The gas is forced into a pipeline. The liquid component is removed from the holding tank 6 through the outflow conduit for liquid 10. The liquid is forced to a pipeline for liquid by the holding tank pump 12.

Figure 2:
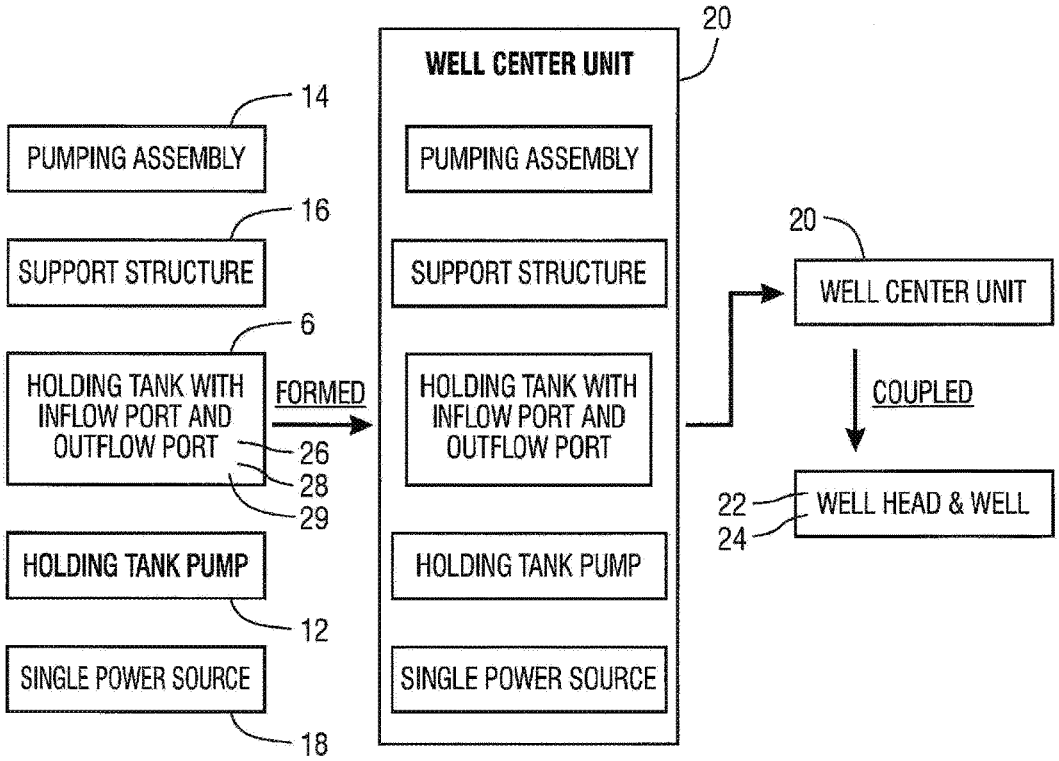
FIG. 2 shows a flow chart tracing the formation of a well center unit from a plurality of components and how the well center unit is connected with the wellhead and into the well.

FIG. 2 shows a flow chart tracing the formation of a well center unit 20 from a plurality of components and how the well center unit 20 is coupled with the wellhead 22 and into the well 24. The well center unit 20 is formed from: a pumping assembly 14; a support structure 16, a holding tank 6 with an inflow port 26 and a plurality of outflow ports 28 and 29; a holding tank pump 12; and a single power source 18. After the well center unit 20 is formed, it is coupled to a wellhead 22 and into a well 24.

Figure 3:
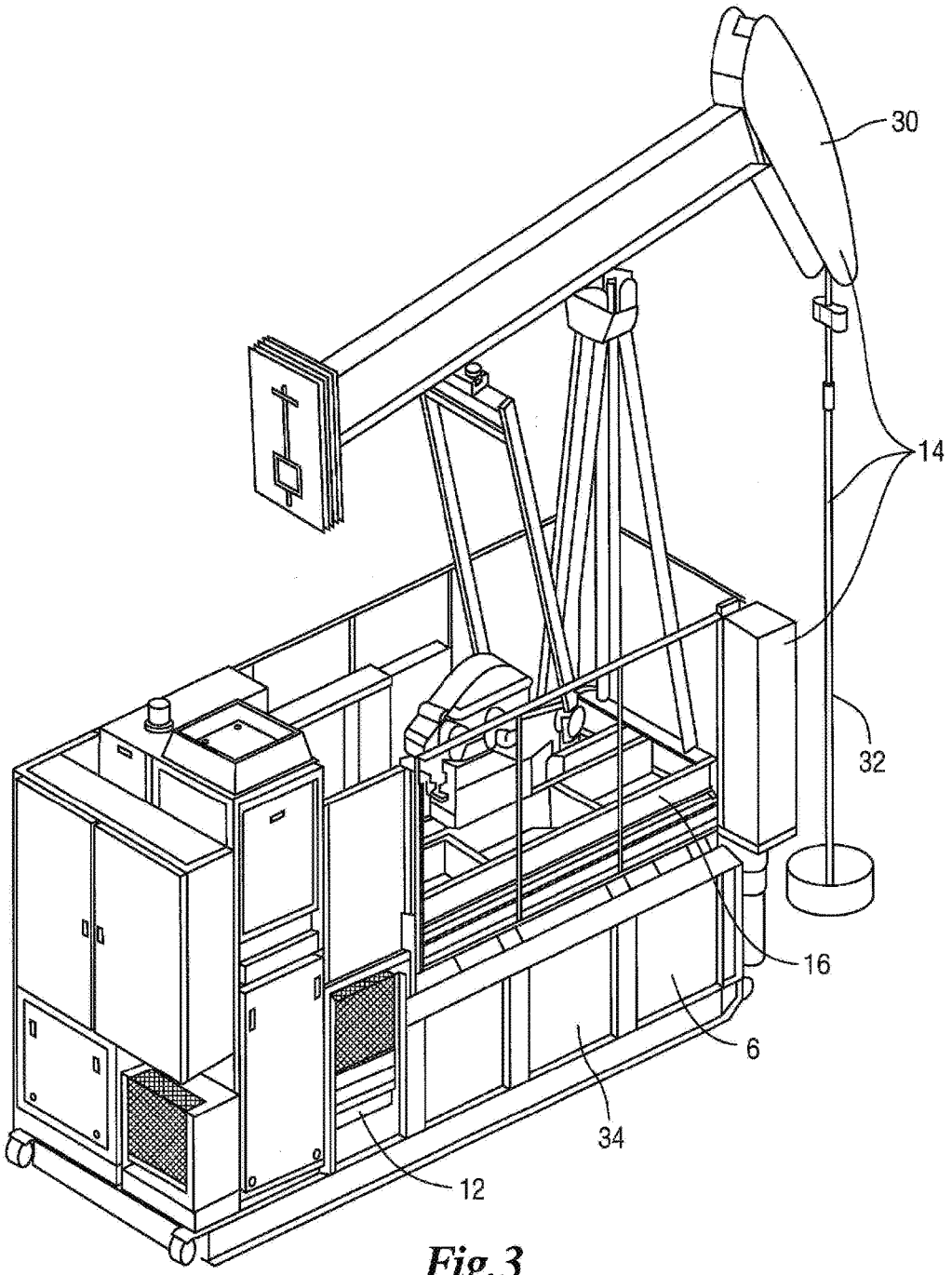
FIG. 3 shows an isomeric view of the apparatus for elevating a pumping assembly.

FIG. 3 shows an isomeric view of the apparatus for elevating a pumping assembly 14. The pumping assembly has a pump-jack 30 connected to a support structure 16 and a rod string 32 going through the wellhead 22 and into the well 24. The support structure 16 forms a lower cavity 34 underneath the support structure 16. A holding tank 6 is located within the lower cavity 34. A holding tank pump 12 is used to force liquid from the holding tank to a pipeline, thereby removing the liquid from the well site.

Figure 4:
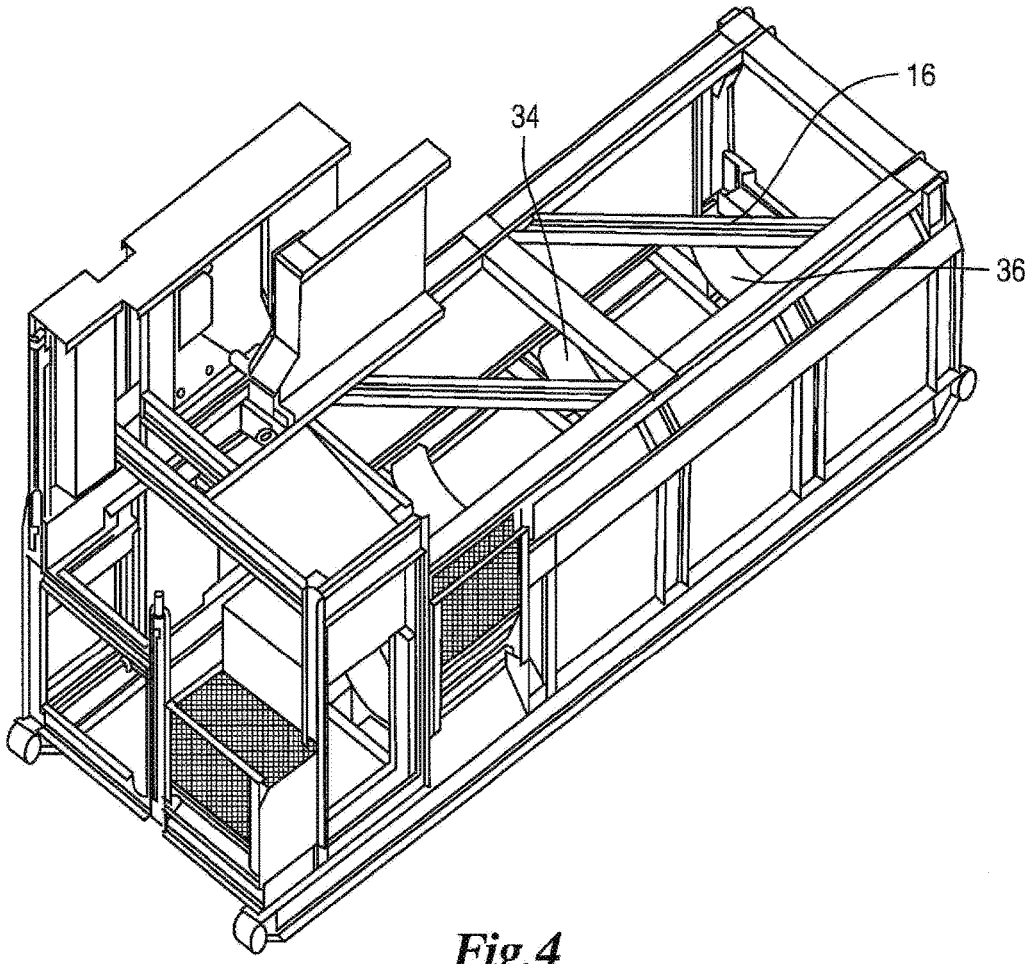
FIG. 4 shows an isomeric view of the support structure for the pumping assembly including the lower cavity in which the holding tank is located.

FIG. 4 shows an isomeric view of the support structure 16 for the pumping assembly 14 including the lower cavity 34 in which the holding tank 6 is located. There are also holding tank saddles 36 within the lower cavity for supporting the holding tank 6.

Figure 5:
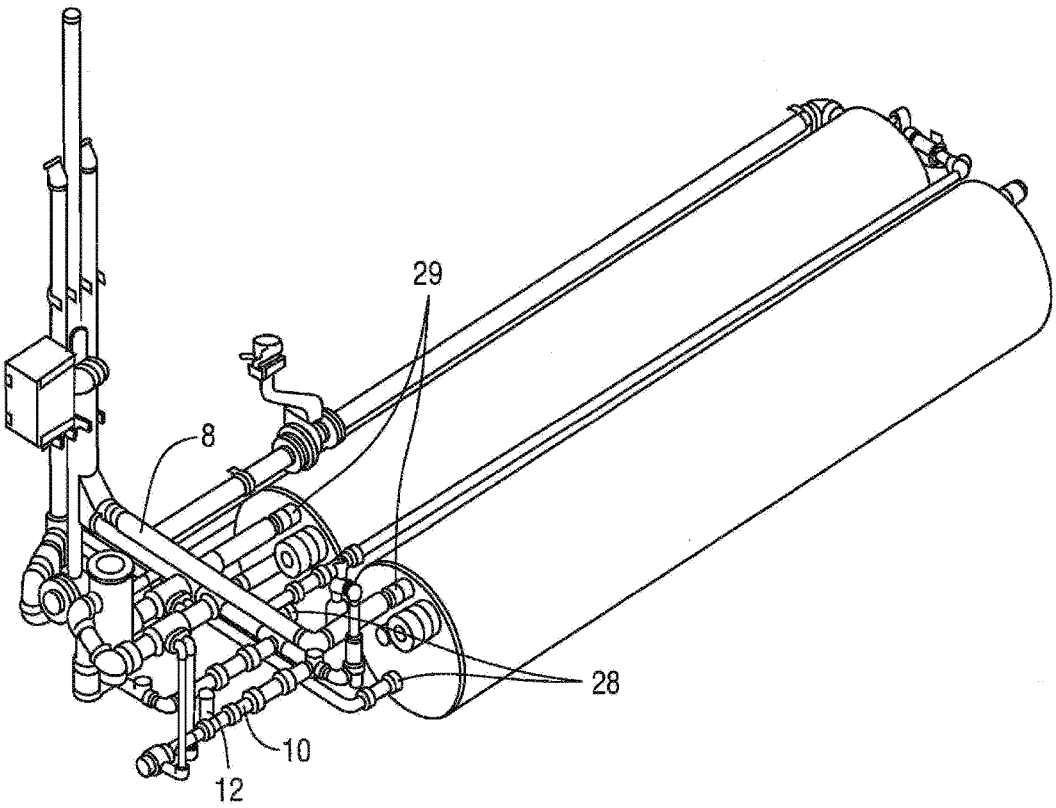
FIG. 5 shows an isomeric view of the holding tanks including the inflow and outflow ports and the holding tank pump for pumping liquid through a liquid pipeline.

FIG. 5 shows an isomeric view of the holding tanks 6 including the inflow port 26, the outflow port for liquid 28, and the outflow port for gas 29. Liquid is removed through the outflow port 28, to the conduit 10, and is forced to a pipeline by the holding tank pump 12. Gas is removed from the holding tank 6 through the outflow port for gas 29 and into the outflow conduit for gas 11.

Figure 6:
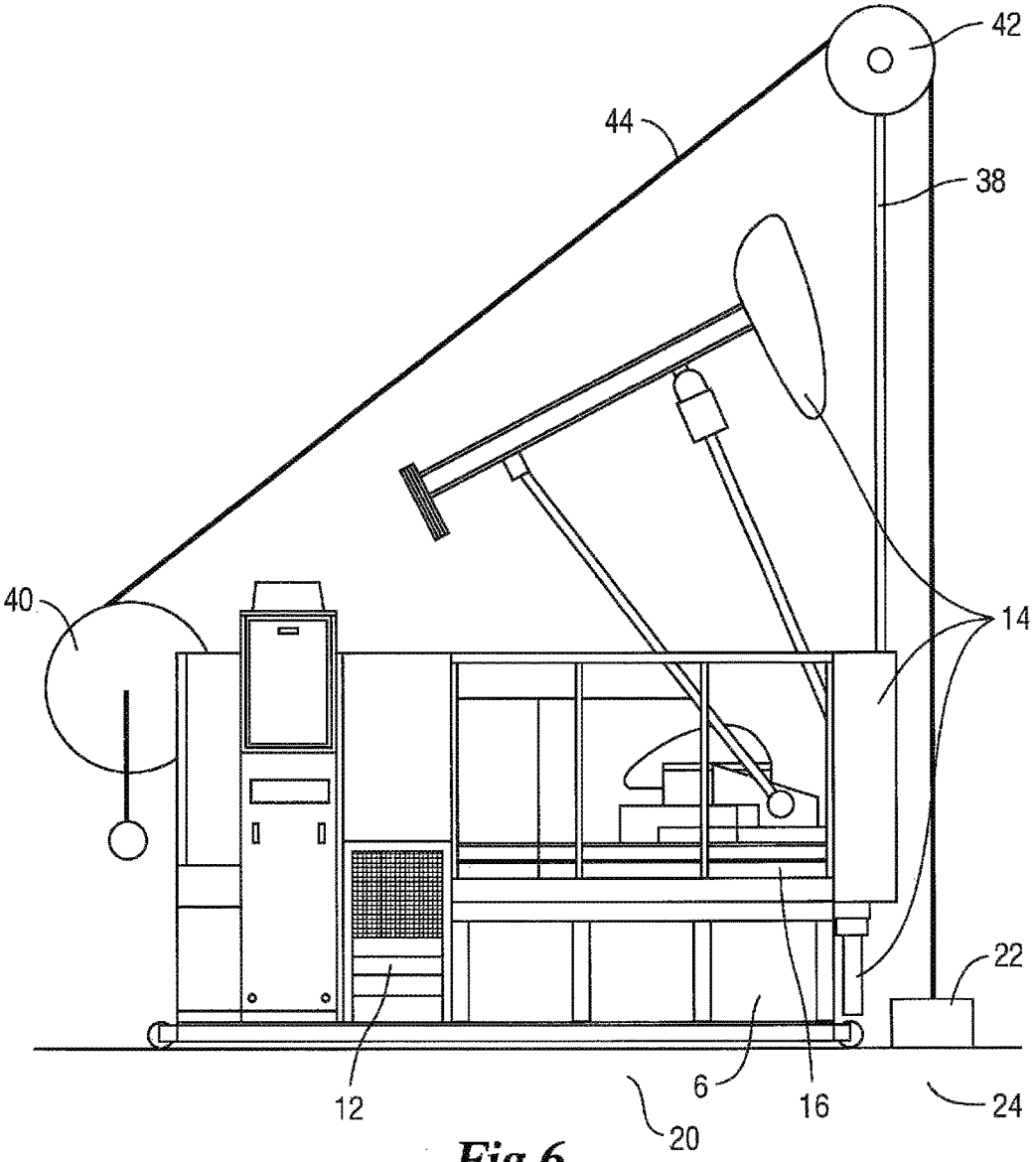
FIG. 6 shows an isomeric view of the well center unit with the removable gin pole attached, which is used for providing maintenance services to the unit.

FIG. 6 shows an isomeric view of the well center unit 20 with the removable gin pole 38 attached, which is used for providing maintenance services to the unit. The figure depicts the pumping assembly 14 anchored to the support structure 16. Elements including the holding tank 6 and the holding tank pump 12 are located beneath the pumping assembly 14 in the lower cavity 34 formed by the support structure 16. The gin pole 38 is anchored to the support structure 16. A cable 44 runs from the crank 40, over the pulley 42 attached to the gin pole 38, past the wellhead 22, and into the well 24.

FIGS. 1-6 show a person of ordinary skill in the art how to make and use the preferred embodiment of the invention. All teachings in the drawings are hereby incorporated by reference into the specification.

Various changes could be made in the above construction and method without departing from the scope of the invention as defined in the claims below. It is intended that all matters contained in the paragraphs above, as shown in the accompanying drawings, shall be interpreted as illustrative and not as a limitation.

We claim:

1. A method of removing liquid from a gas producing well, comprising:

(a) accepting a periodic surge of a fluid, brought to the surface by a down hole well pump of a pumping assembly driven by a power source, into a holding tank through an inflow conduit having a cross-sectional area capable of accepting the surge;

(b) with a continuous flow of fluid being injected therein, allowing the fluid in the holding take to separate to a liquid component and, if there is a gas component, a gas component;

(c) while the continuous flow of fluid is being injected into the holding tank, removing the liquid component separately at a substantially constant flow rate from the holding tank through a horizontal outflow conduit having a smaller cross-sectional area than the inflow conduit;

(d) combining the power source to power both the down-hole pump and a holding tank pump; and (e) forcing the liquid at the substantially constant flow rate from the outflow conduit through a pipeline in which gas is substantially absent, thereby removing the liquid from the well.

2. The method as recited in claim 1 wherein the output conduit is directly connected to the pipeline.

3. A method of removing liquid from a gas producing well, comprising:

(a) accepting a periodic surge of a fluid, brought to the surface by a down hole well pump, into a holding tank through an inflow conduit having a cross-sectional area capable of accepting the surge;

(b) warming the fluid in the holding tank so that the fluid will not freeze;

(c) with a continuous flow of fluid being injected into the holding tank, allowing the fluid in the holding tank to separate to a liquid component and, if there is a gas component, a gas component;

(d) while the continuous flow of fluid is being injected into the holding tank, removing the liquid component at a substantially constant flow rate from the holding tank through a horizontal outflow conduit having a smaller cross-sectional area than the inflow conduit; and (e) forcing the liquid at the substantially constant flow rate from the outflow conduit through a pipeline, thereby removing the liquid from the well.

4. The method as recited in claim 3 wherein the output conduit is directly connected to the pipeline.

5. A method of separating a gas and liquid fluid brought to the surface by a down hole well pump, comprising:

(a) accepting a periodic surge of a fluid, brought to the surface by the down hole well pump, into a holding tank through an inflow conduit having a cross-sectional area capable of accepting the surge;

(b) warming the fluid in the holding tank so that the fluid will not freeze;

(c) with a continuous flow of fluid being injected therein, allowing the fluid in the holding tank to separate to a liquid component and, if there is a gas component, a gas component;

(d) while the continuous flow of fluid is being injected into the holding tank, removing the gas component from the holding tank through a vertical gas outflow conduit and forcing the gas component to a gas pipeline;

(e) removing the liquid component separately at a substantially constant flow rate from the holding tank through a horizontal outflow conduit having a smaller cross-sectional area than the inflow conduit; and (f) forcing the liquid at the substantially constant flow rate from the outflow conduit through a pipeline in which gas is substantially absent, thereby removing the liquid from the well.

6. The method as recited in claim 5, wherein the forcing of step (f) is performed by a pump other than the down-hole pump.

7. The method as recited in claim 5, wherein the gas component is vertically routed out of a footprint of a well center unit comprising the holding tank.

8. The method as recited in claim 5 wherein the output conduit is directly connected to the pipeline.

* * * * *